US009567202B2

(12) United States Patent
Walker et al.

(10) Patent No.: US 9,567,202 B2
(45) **Date of Patent: *Feb. 14, 2017**

(54) SYSTEM FOR ILLUMINATED TAP HANDLES

(71) Applicant: illumiTap LLC, Boynton Beach, FL (US)

(72) Inventors: Andrew S. Walker, Vero Beach, FL (US); James R. Lester, Lambton Shores (CA); Brian D. G. Maxfield, Camlachie (CA)

(73) Assignee: ILLUMITAP LLC, Boynton Beach, FL (US)

( * ) Notice: Subject to any disclaimer, the term of this patent is extended or adjusted under 35 U.S.C. 154(b) by 781 days.

This patent is subject to a terminal disclaimer.

(21) Appl. No.: 13/856,010

(22) Filed: Apr. 3, 2013

(65) Prior Publication Data

US 2014/0301064 A1 Oct. 9, 2014
US 2016/0214850 A9 Jul. 28, 2016

Related U.S. Application Data

(63) Continuation-in-part of application No. 13/403,185, filed on Feb. 23, 2012, now Pat. No. 9,079,759, and a continuation-in-part of application No. PCT/US2012/058830, filed on Oct. 5, 2012.

(60) Provisional application No. 61/585,471, filed on Jan. 11, 2012.

(51) Int. Cl.

| | |
|---|---|
| ***B67D 1/08*** | (2006.01) |
| ***B67D 7/14*** | (2010.01) |
| *F21Y 101/00* | (2016.01) |

(52) U.S. Cl.
CPC ..... *B67D 1/0874* (2013.01); *B67D 7/145* (2013.01); *F21Y 2101/00* (2013.01)

(58) Field of Classification Search
CPC ..... A46B 15/0036; A46B 2200/1066; A46B 15/0044; B60Q 3/0233; B67D 7/145; B67D 1/0874; F21Y 2101/02
USPC ..... 15/105, 167.1, 22.1, 247; 362/501, 509, 362/100, 109, 511, 544, 546, 96, 183, 802; 600/249; 16/412; 239/71; 292/336.3; 200/310; 222/113, 52; 40/332
See application file for complete search history.

(56) References Cited

U.S. PATENT DOCUMENTS

| | | | | |
|---|---|---|---|---|
| 3,321,861 A * | 5/1967 | Tate, Jr. | ..... | 40/332 |
| 4,225,057 A * | 9/1980 | Horn | ..... | 222/27 |
| 7,096,617 B2 * | 8/2006 | Bydalek et al. | ..... | 40/332 |

* cited by examiner

*Primary Examiner* — Stephen F Husar
*Assistant Examiner* — Danielle Allen

(57) ABSTRACT

A system for illuminated tap handles includes at least one tap handle, at least one charging unit, at least one control device (remote control), and a plurality of web enabled computing devices. The at least one tap handle provides illumination through a transparent handle casing, where the illumination is provided by a LED light strip. The LED light strip can be controlled and operated by the plurality of web enabled computing devices and a remote control device. The at least one charging unit provides a wireless internet network for the plurality of web enabled computing devices, and sends out text messages to the plurality of web enabled computing device through the wireless network and a personal-area network.

20 Claims, 14 Drawing Sheets

SECTION D-D
SCALE 1 : 3

SYSTEM FOR ILLUMINATED TAP HANDLES

The current application is a continuation in part of U.S. patent application Ser. No. 13/403,185 filed Feb. 23, 2011, which claims benefit of U.S. Provisional Patent Application No. 61/585,471 filed Jan. 11, 2012. Further, the current application is a continuation in part of PCT Patent Application Number PCT/US2012/058830 filed Oct. 5, 2012, which claims benefit of U.S. Provisional Patent Application No. 61/585,471 filed Jan. 1, 2012.

FIELD OF THE INVENTION

The present invention relates generally to an apparatus for a handle. More specifically, the apparatus is an illuminated tap handle that comprises a charging unit and a remote control device, where the present invention provides text messaging technology and communication technology creating a network system in between a plurality of users.

BACKGROUND OF THE INVENTION

Beer tap handles have been used by a wide variety of people for centuries to dispense beer. The beer handles have evolved into many different shapes and forms throughout the years. Different types of beer tap handles often display different designs and decals for promotional purposes. Currently, there are no beer tap handles that utilize a remote operation for illuminative purpose.

It is therefore an object of the present invention to introduce a plurality of illuminated tap handle that comprises at least one charging unit, and a remote control device, where users have complete control over the desired lighting effects of the plurality of illuminated tap handles. It is further objective of the present invention to provide a wireless internet network and text messaging technology so that the customers of an establishment can join in to the wireless internet network to use the internet, and the owners are able to promote their business through the text messaging and communication technology. Animation technology, such as scrolling messages on the face of the tap handle, can also be added to the present invention to promote the establishment.

DETAIL DESCRIPTIONS OF THE INVENTION

All illustrations of the drawings are for the purpose of describing selected versions of the present invention and are not intended to limit the scope of the present invention.

Figure 1:
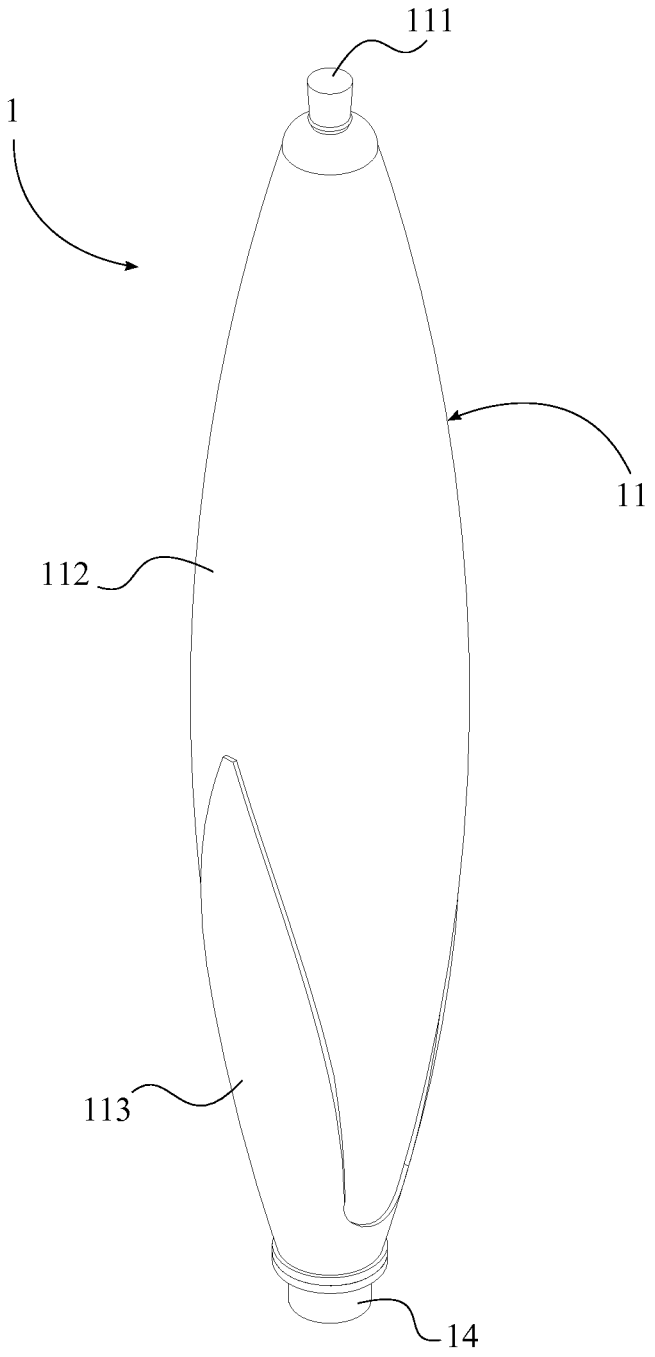
FIG. 1 is a perspective view of a tap handle of the present invention.

The present invention is a system for illuminated tap handles that comprises at least one tap handle 1, a remote control device 2, at least one charging unit 3, and a plurality of web enabled computing devices 4. The at least one tap handle 1 is used within restaurants and bars so that beer can be drafted from a pressurized container. in reference to FIG. 1, FIG. 2, and FIG. 3, each of the at least one tap handle 1 comprises a handle casing 11, a light-emitting diode (LED) light strip 12, a battery 13, a bottom connector 14, and a handle chipset 15. The handle casing 11, which is an enclosure, comprises a top connector 111, a transparent face 112, and a holder 113.

Figure 2:
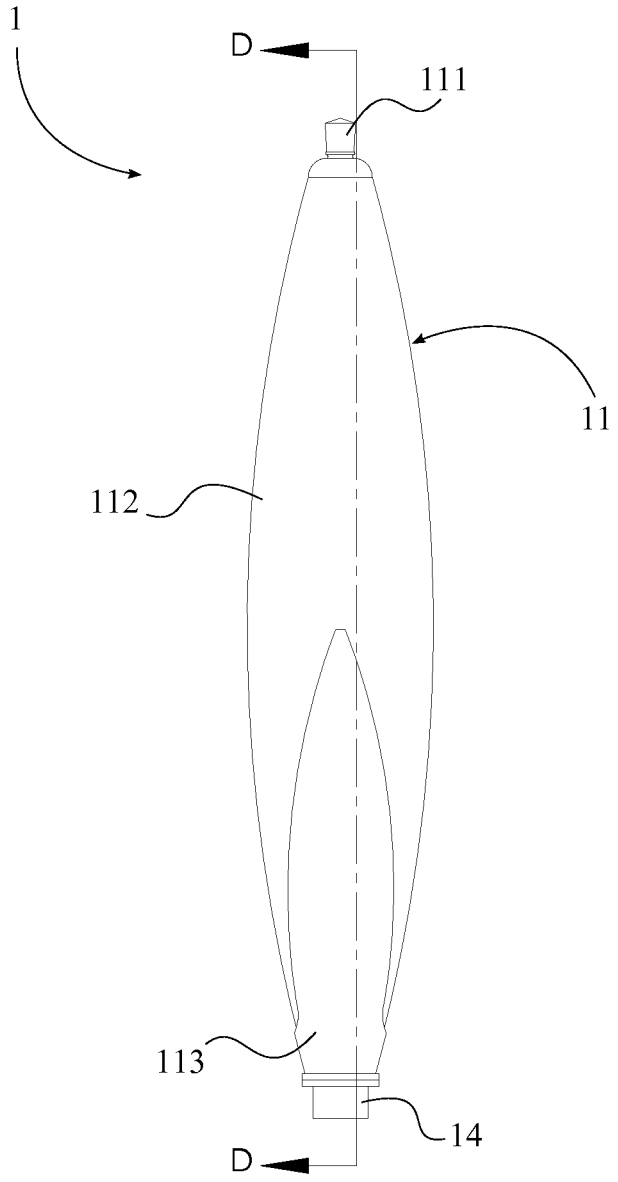
FIG. 2 is a front view of the tap handle of the present invention, showing the plane upon which a cross section view is taken shown in FIG. 3.

In reference to FIG. 2, the handle casing 11 is positioned above the bottom connector 14. More specifically, the transparent face 112 hermetically connects with both the top connector 111 and the holder 113 at each extremity, where the top connector 111 and the holder 113 are oppositely positioned from each other along the transparent face 112. The transparent face 112 is made out of any type of transparent materials, including, but not limited to, clear plastic, tempered glass and composite materials. The transparent face 112 can be made into different decals with reference to different beer companies so that every beer company can reach their branding requirements. The top connector 111 and the holder 113 are preferably made from stainless steel. Even though, stainless steel is used to manufacture the top connector 111 and the holder 113, any other type of corrosion free materials can be used to manufacture the top connector 111 and the holder 113. The bottom connector 14 is hermetically connected with the holder 113, where the bottom connector 14 is designed to fit the handle casing 11 with the current models of beer towers in use today. The bottom connector 14 comprises a female threaded connection which connects the handle casing 11 to the beer towers already installed in restaurants and bars in North America, since the existing beer towers comprise male threaded connections. According to the demand, the female threaded connection of the handle casing 11 can be changed into a male threaded connection, if the existing beer towers comprise female threaded connections. The bottom connector 14 is preferably made from stainless steel. Even though, stainless steel is used to manufacture the bottom connector 14, any other type of corrosion free and durable materials, such as plastic and aluminum alloy, can be used to manufacture the bottom connector 14.

Figure 3:
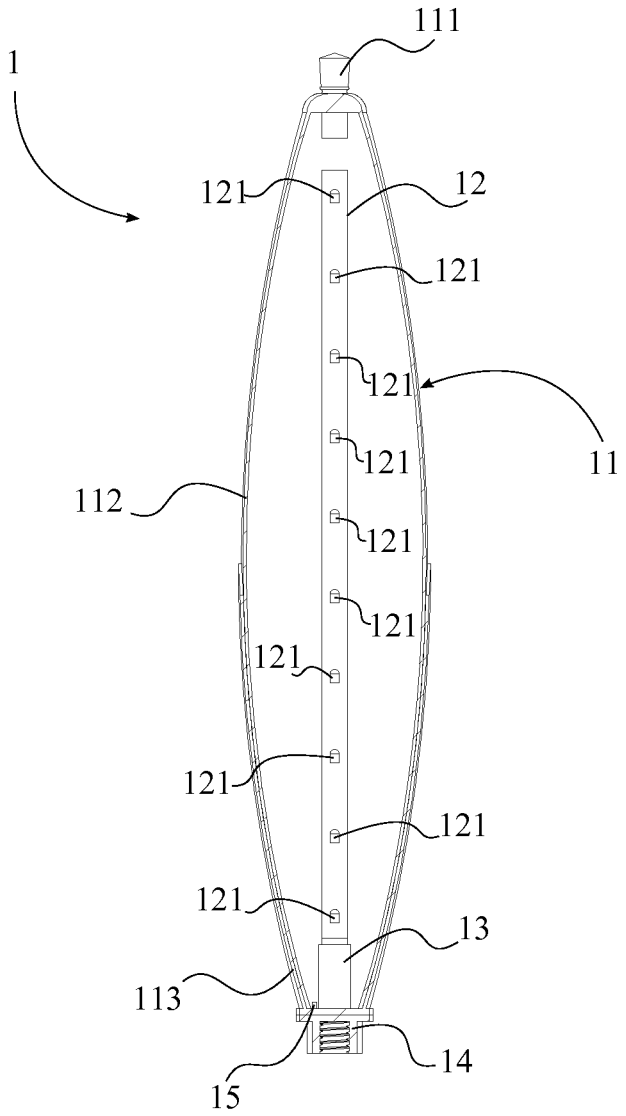
FIG. 3 is a cross section view of the tap handle of the present invention taken along line D-D of FIG. 2.

In reference to FIG. 3, the LED light strip 12, the battery 13, and the handle chipset 15 are positioned within the handle casing 11. More specifically, the battery 13 and the handle chipset 15 are oppositely positioned from the bottom connector 14 and connected with the holder 113. A lithium ion battery is preferably used as the battery 13 which holds about eight to twelve hours of battery life per cycle. The battery 13 is hermetically sealed inside the handle casing 11 which prevents any kind liquid damage that may occur during the usage of the at least one tap handle 1. Since the battery 13 is hermetically sealed, the battery 13 can stand up to the high demands and damages involved with a given working environment. The battery 13 is the only power source for the LED light strip 12, and the battery 13 is preferably charged through induction charging, eliminating the need for electrical contact points. Since the electrical contact points are removed from the present invention and the battery 13 is sealed within the handle casing 11, the usual damages that occur with related to the battery 13 and the electrical contact points due to liquid contaminations and heavy use are completely eliminated from the present invention.

Figure 14:
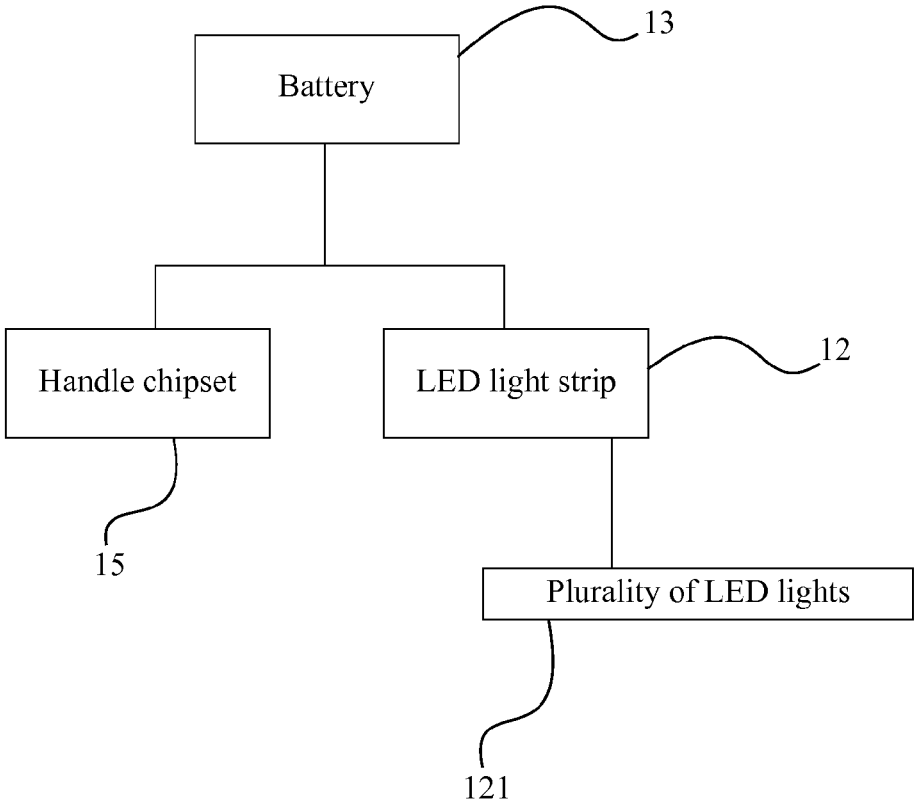
FIG. 14 is an illustration showing the basic electrical connections of the tap handle of the present invention.

The LED light strip 12 is positioned in between the battery 13 and the top connector 111. The LED light strip 12 is hermetically sealed within the handle casing 11 so that the LED light strip 12 is protected from any kind of corrosion or liquid damages. Since the LED light strip 12 is hermetically sealed, the LED light strip 12 can stand up to the high demands and damages involved with a given working environment. In reference to FIG. 3 and FIG. 14, the LED light strip 12 comprises a plurality of light-emitting diode (LED) lights 121, where the plurality of LED lights 121 is positioned in a vertical line along the LED light strip 12 and electrically connected to each other. Red, green, blue, and white LED lights are used as the plurality of LED lights 121. The plurality of LED lights 121 and the mentioned four different colors allow the users of the present invention to have the complete control over the color spectrum. For example, if advertisements are displayed through the transparent face 112, the plurality of LED lights 121 illuminates in white color so that the advertisements can be clearly displayed with the designated colors. If the users of the present invention decide to simply use one specific color to illuminate the at least one tap handle 1, the users are able to select that one specific color. Having the ability to change the color scheme with the present invention is a unique improvement so that the at least one tap handle 1 can be used with personalized events which comprise specific color themes and holidays associated with colors. For example, the at least one tap handle 1 can be illuminated with red color around the Valentine's Day, providing an aesthetically pleasing surrounding area for the customers. In reference to FIG. 14 and FIG. 12, the battery 13, the handle chipset 15, and the LED light strip 12 are electrically connected to each other. The handle chipset 15, which operates the LED light strip 12, is communicably coupled with the LED light strip 12.

In reference to FIG. 5, FIG. 6, FIG. 8, and FIG. 10, the at least one charging unit 3 comprises an attachment cavity 41, a wireless personal-area network module 42, a wireless local area network module 43, a power supply unit 45, a charging unit chipset 46, and a wide area network (WAN) port 44. The size of the at least one charging unit 3 depends on number of the at least one tap handle 1 needs to charge, and the shape depends on the functionality, where the shape can be any geometric and organic shape. The attachment cavity 41 is positioned on the at least one charging unit 3, where the attachment cavity 41 provides a breach so that the bottom connector 14 can be inserted into the attachment cavity 41 in order to recharge the battery 13. Since the battery 13 is charged through the induction charging, the attachment cavity 41 provides structural support to the at least one tap handle 1 when the battery 13 is recharging. The induction charging of the at least one charging unit 3 allows the at least one tap handle 1 to last a longer service life as the at least one charging unit 3 minimizes the damage for the bottom connector 14 and the at least one tap handle 1. The at least one charging unit 3 is able to fully charge the battery 13 overnight so that the at least one tap handle 1 can be ready for the next business day. The at least one tap handle 1 can also charge through direct charging in order to fully charge the at least one tap handle 1 within a short amount of time compare to the induction charging. Then the at least one charging unit 3 provides direct charging system.

Figure 5:
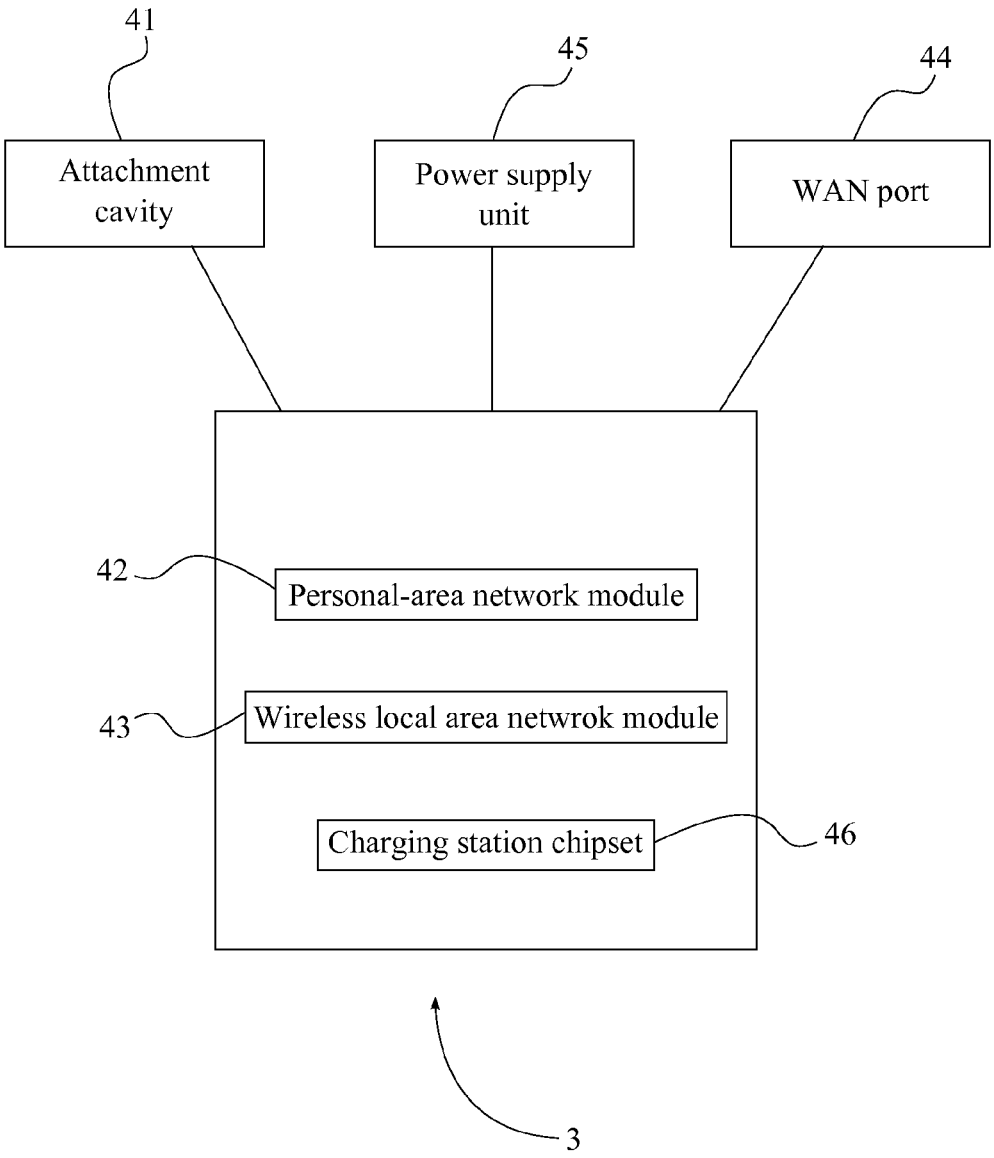
FIG. 5 is an illustration showing the components of a charging unit of the present invention.
Figure 13:
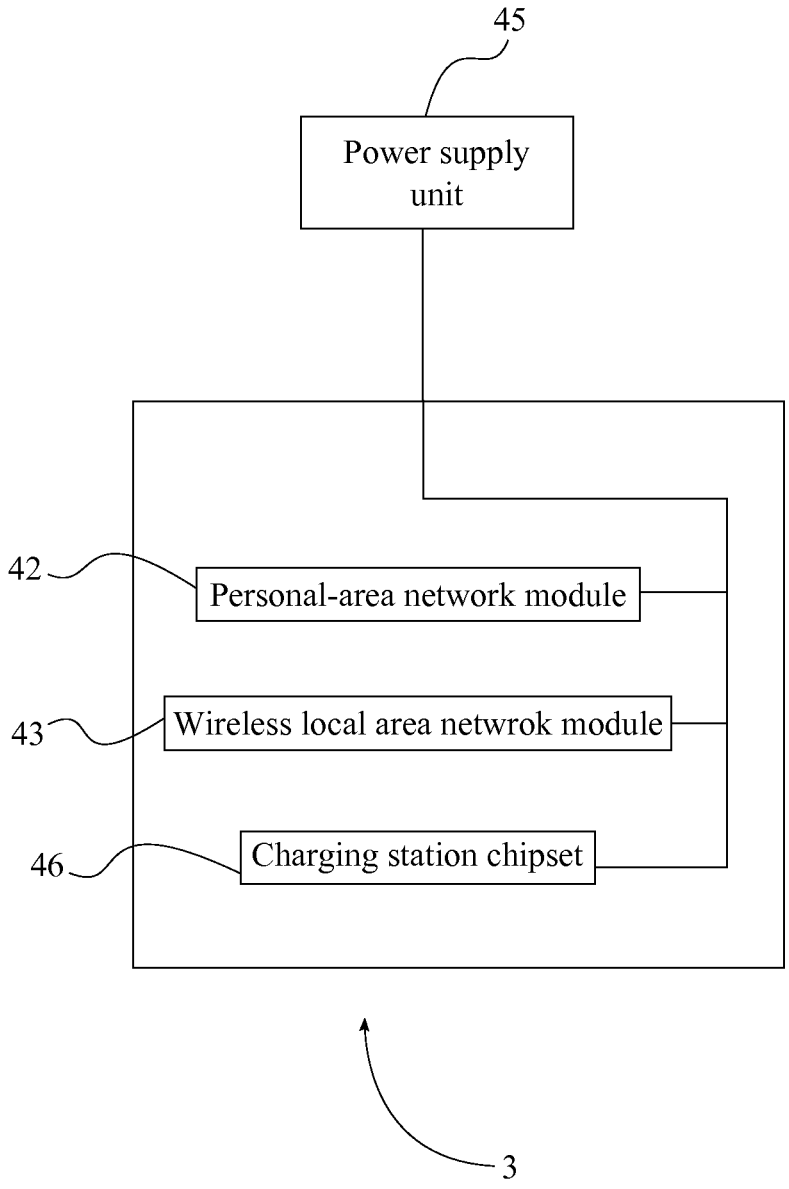
FIG. 13 is an illustration showing the basic electrical connections of the charging unit of the present invention.

In reference to FIG. 5, the WAN port 44 is positioned on the at least one charging unit 3, and the WAN port 44 hardwires the at least one charging unit 3 with an internet providing source, providing internet to the at least one charging unit 3. The wireless personal-area network module 42, the charging unit chipset 46, and the wireless local area network module 43 are positioned within the at least one charging unit 3. The wireless personal-area network module 42 provides a personal-area network with a predetermine coverage area. The wireless local area network module 43 provides a wireless network with a predetermine coverage area. The WAN port 44 is communicably coupled with the wireless personal-area network module 42, the charging unit chipset 46, and the wireless local area network module 43. The charging unit chipset 46, which process information and send out short text messages with a website landing link, is communicably coupled with the wireless personal-area network module 42 and the wireless local area network module 43. The power supply unit 45 is positioned on the at least one charging unit 3, where the power supply unit 45 provides the necessary electrical power from an external power source so that the at least one charging unit 3 can be powered. In reference to FIG. 13, the power supply unit 45 is electrically connected with the wireless personal-area network module 42, the charging unit chipset 46, and the wireless local area network module 43.

Figure 6:
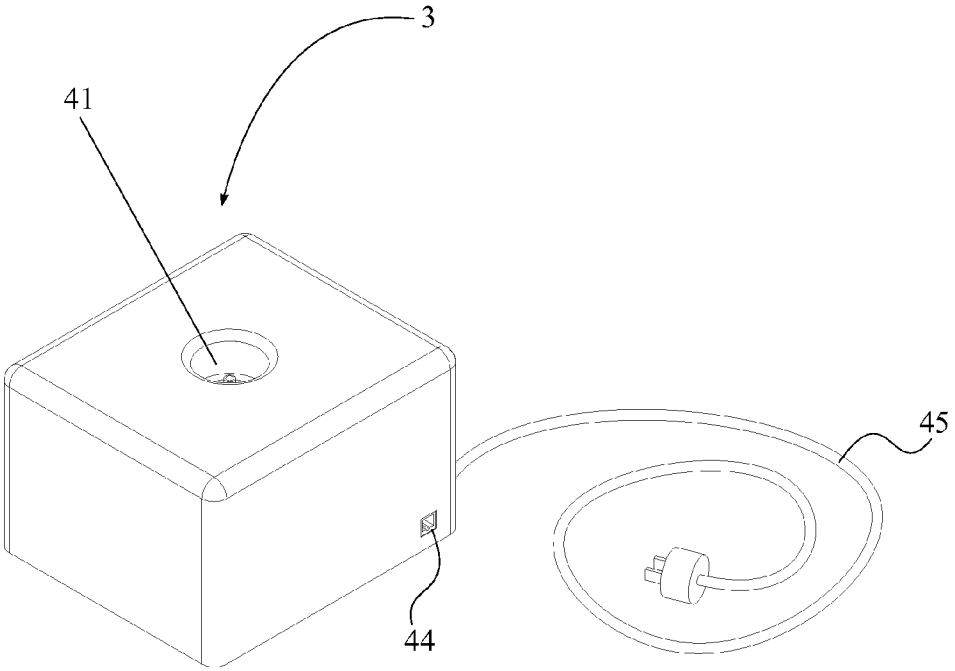
FIG. 6 is a perspective view of a preferred embodiment of the charging unit.
Figure 7:
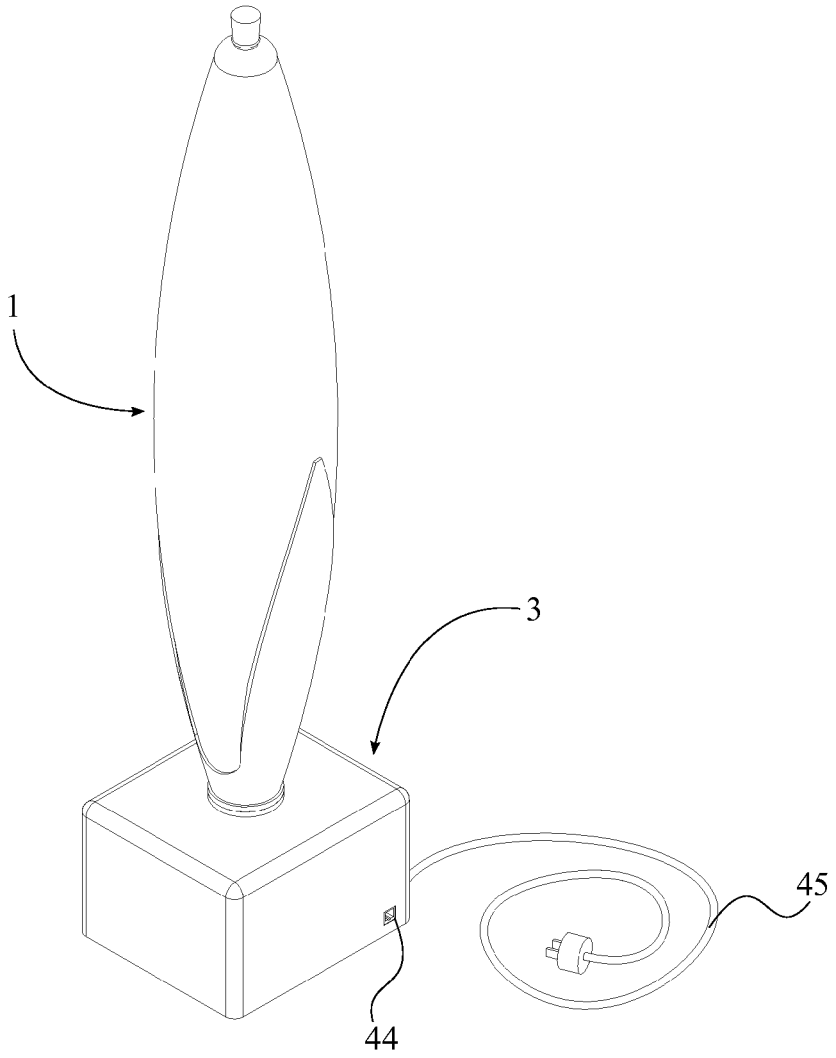
FIG. 7 is a perspective view of the preferred embodiment of the charging unit and the tap handle.

In reference to FIG. 6 and FIG. 7, a preferred embodiment of the at least one charging unit 3 comprises a base. The attachment cavity 41, the WAN port 44, and the power supply unit 45 are positioned on the base, and the wireless personal-area network module 42, the charging unit chipset 46, and the wireless local area network module 43 are positioned within the base. Even though the at least one tap handle 1 is illustrated with the preferred embodiment of the at least one charging unit 3, a plurality of tap handles 1 can be used with the preferred embodiment of the at least one charging unit 3 as the attachment cavity 41 expands to a plurality of attachment cavities 41. The base provides a steady platform for the at least one tap handle 1 so that the weight of the at least one tap handle 1 doesn't overturn the at least one charging unit 3.

Figure 8:
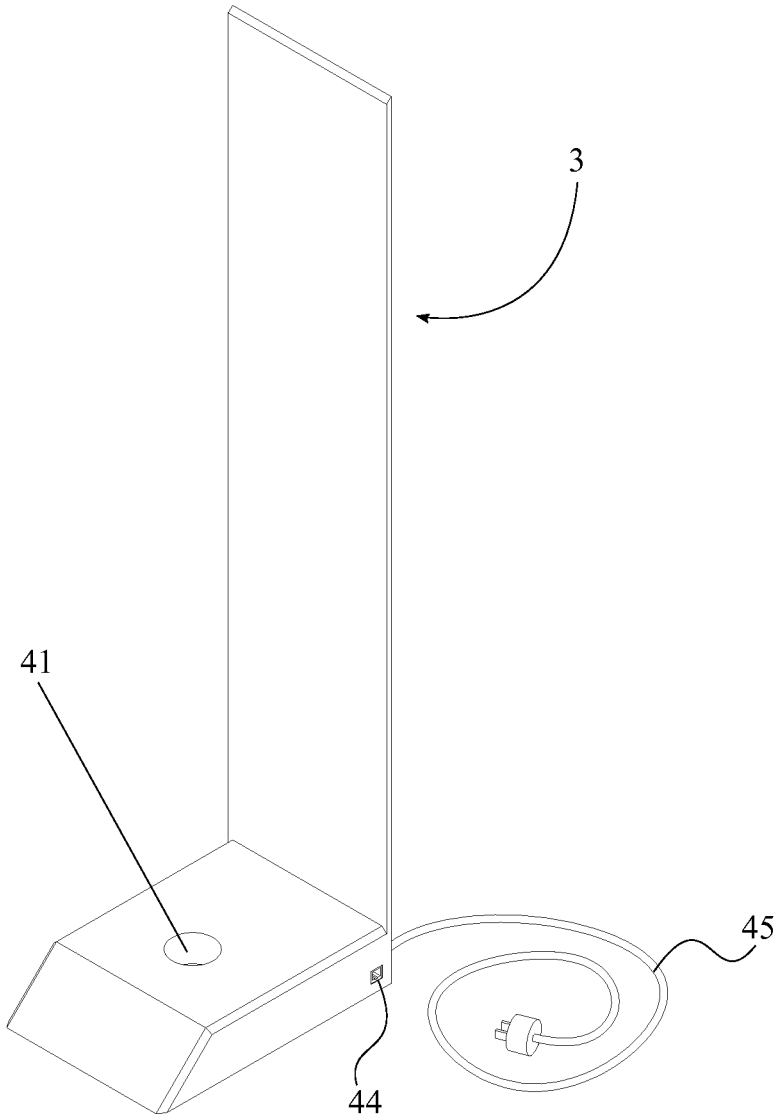
FIG. 8 is a perspective view of a first alternative embodiment of the charging unit.
Figure 9:
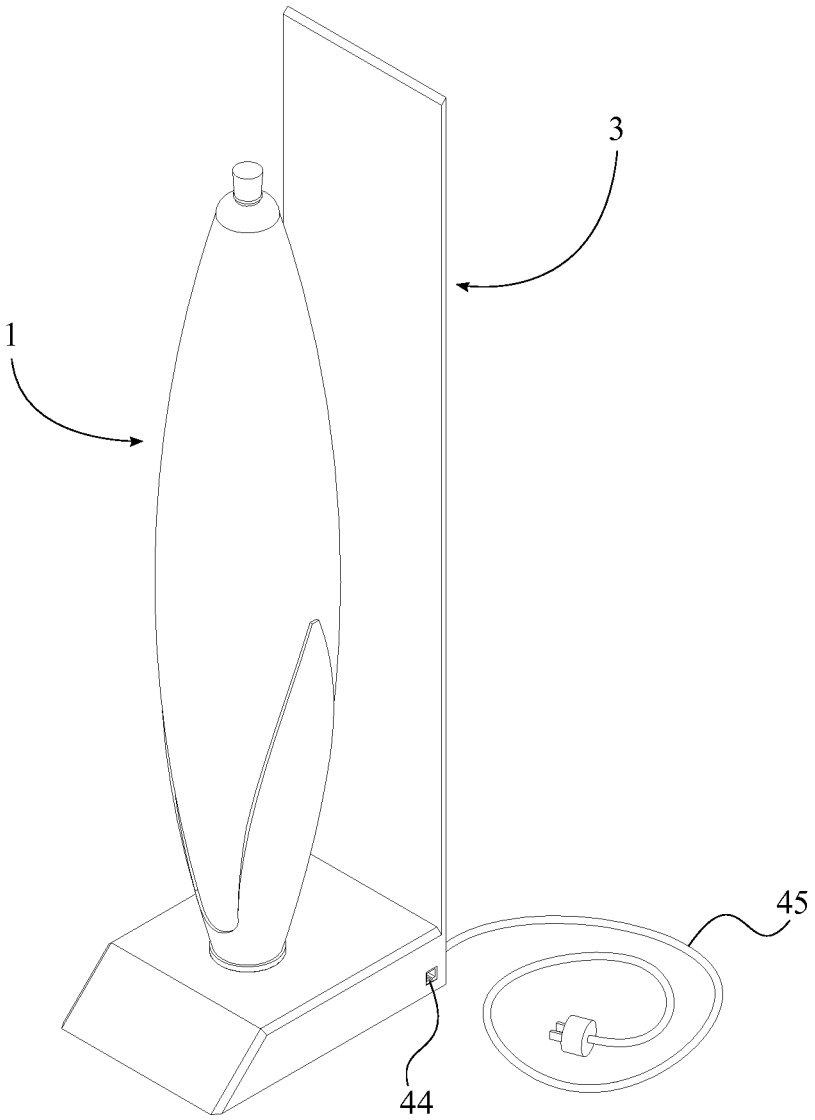
FIG. 9 is a perspective view of the first alternative embodiment of the charging unit and the tap handle.

In reference to FIG. 8 and FIG. 9, a first alternative embodiment of the at least one charging unit 3 comprises a base and a protective cover. The attachment cavity 41, the WAN port 44, and the power supply unit 45 are positioned on the base, and the wireless personal-area network module 42, the charging unit chipset 46, and the wireless local area network module 43 are positioned within the base. Even though the at least one tap handle 1 is illustrated with the first alternative embodiment of the at least one charging unit 3, a plurality of tap handles 1 can be used with the first alternative embodiment of the at least one charging unit 3 as the attachment cavity 41 expands to a plurality of attachment cavities 41. The protective cover provides a protective barrier for each of the at least one tap handle 1 from the surrounding area. The base provides a steady platform for the at least one tap handle 1 so that the weight of the at least one tap handle 1 doesn't overturn the at least one charging unit 3.

Figure 10:
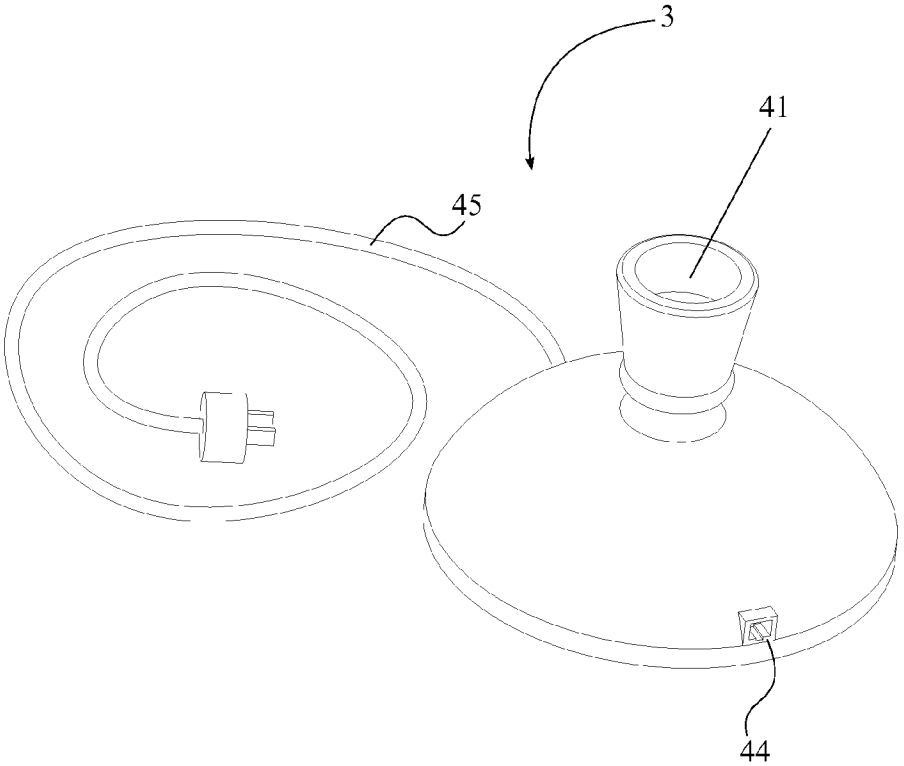
FIG. 10 is a perspective view of a second alternative embodiment of the charging unit.
Figure 11:
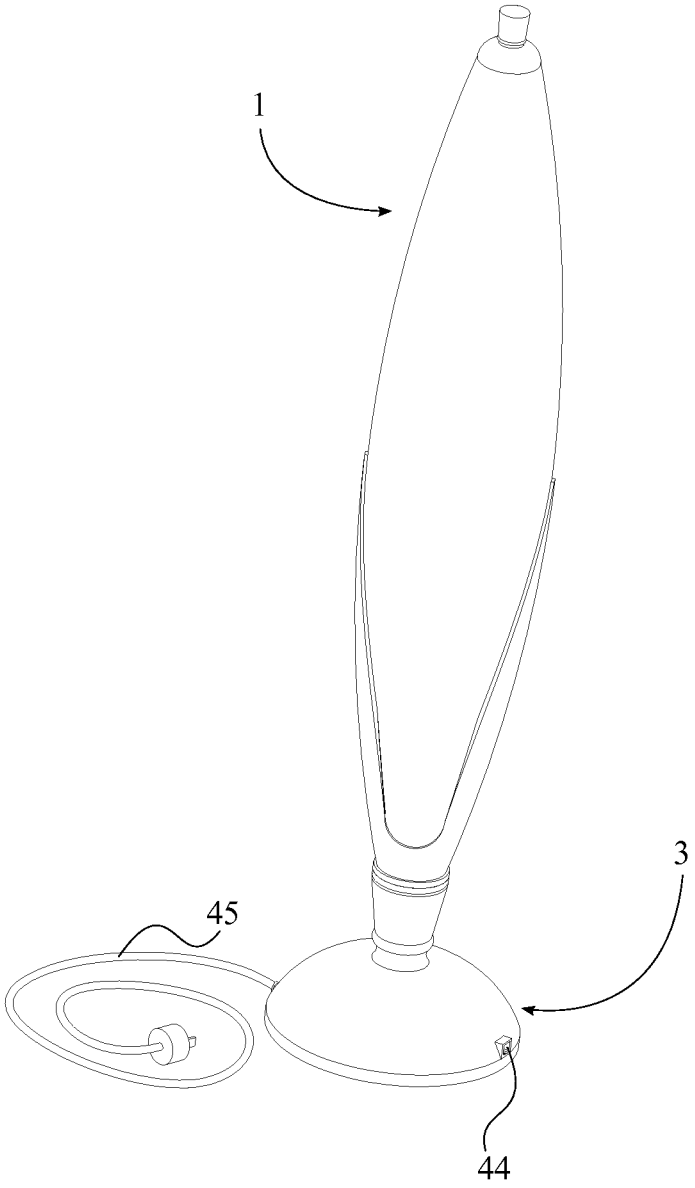
FIG. 11 is a perspective view of the second alternative embodiment of the charging unit and the tap handle.

In reference to FIG. 10 and FIG. 11, a second alternative embodiment of the at least one charging unit 3 comprises a base. The attachment cavity 41, the WAN port 44, and the power supply unit 45 are positioned on the base, and the wireless personal-area network module 42, the charging unit chipset 46, and the wireless local area network module 43 are positioned within the base. Even though the at least one tap handle 1 is illustrated with the second alternative embodiment of the at least one charging unit 3, a plurality of tap handles 1 can be used with the second alternative embodiment of the at least one charging unit 3 as the attachment cavity 41 expands to a plurality of attachment cavities 41. The base provides a steady platform for the at least one tap handle 1 so that the weight of the at least one tap handle 1 doesn't overturn the at least one charging unit 3.

Figure 12:
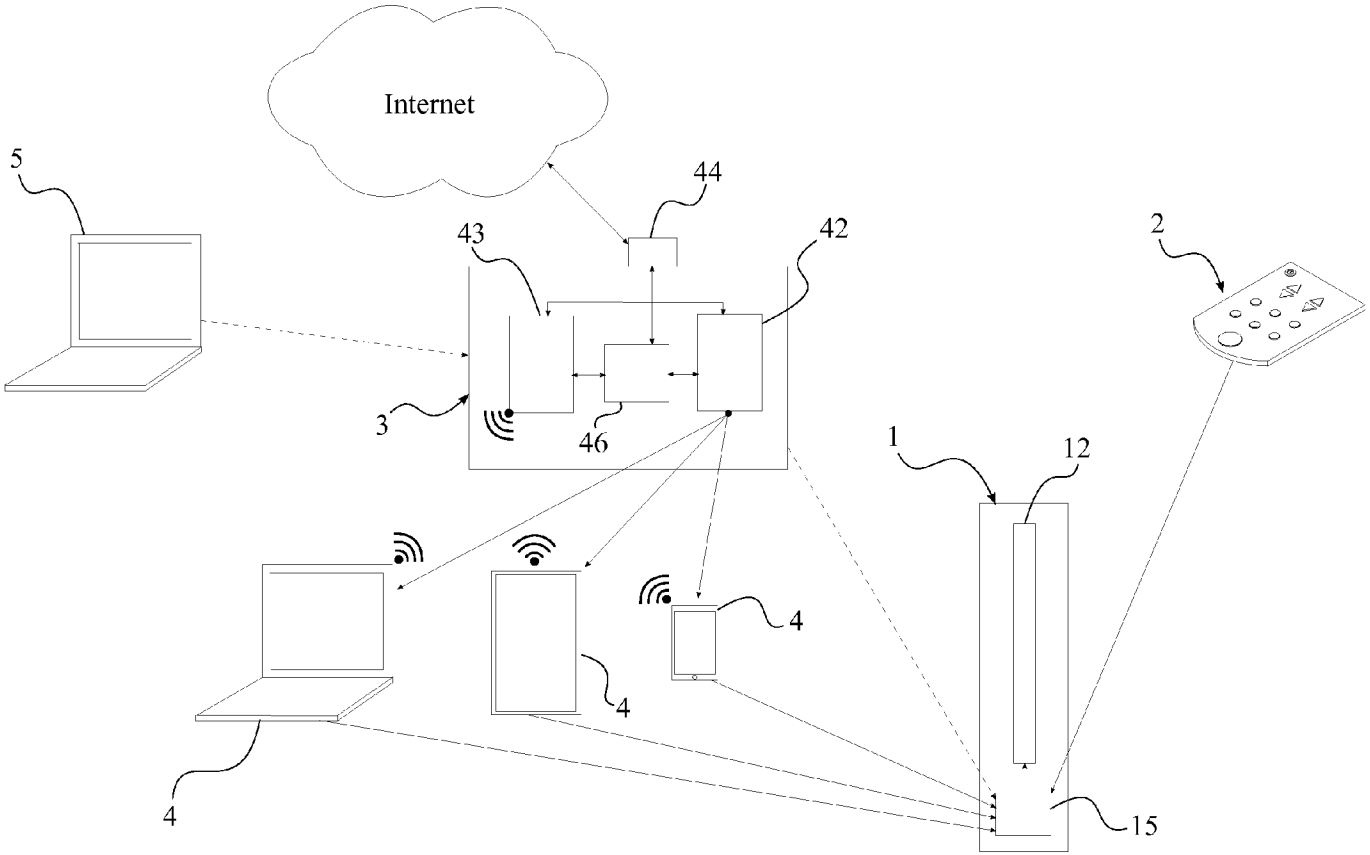
FIG. 12 is an illustration showing the basic communication connections of the present invention.

In reference to FIG. 12, the plurality of web enabled computing devices 4 includes, but not limited to, laptops, smartphones, and tablets. The plurality of web enabled computing devices 4 is able to communicably coupled with the at least one charging unit 3 through either the wireless personal-area network module 42 or the wireless local area network module 43. Once the plurality of web enabled computing devices 4 positions within the predetermine coverage area of the personal-area network, and the plurality of web enabled computing devices 4 is capable of operating within the personal-area network, the plurality of web enabled computing devices 4 is able to communicably coupled with the at least one charging unit 3 through the wireless personal-area network module 42. Then the at least one charging unit 3 automatically sends the short text message with a website landing link to the plurality of web enabled computing devices 4 through the personal-area network, where the short text message with a website landing link optimizes direct marketing. The charging unit chipset 46 is able to process the short text message within the at least one charging unit 3. The plurality of web enabled computing devices 4 can also access internet through the wireless network as a hotspot, if the plurality of web enabled computing devices 4 is positioned within the predetermine coverage area of the wireless network, and the plurality of web enabled computing devices 4 is capable of operating within the wireless network. Once the plurality of web enabled computing devices 4 is communicably coupled with the at least one charging unit 3 through the wireless local area network module 43, the short text message with a website landing link is sent to the plurality of web enabled computing devices 4 through the wireless network, optimizing the direct marketing.

Figure 4:
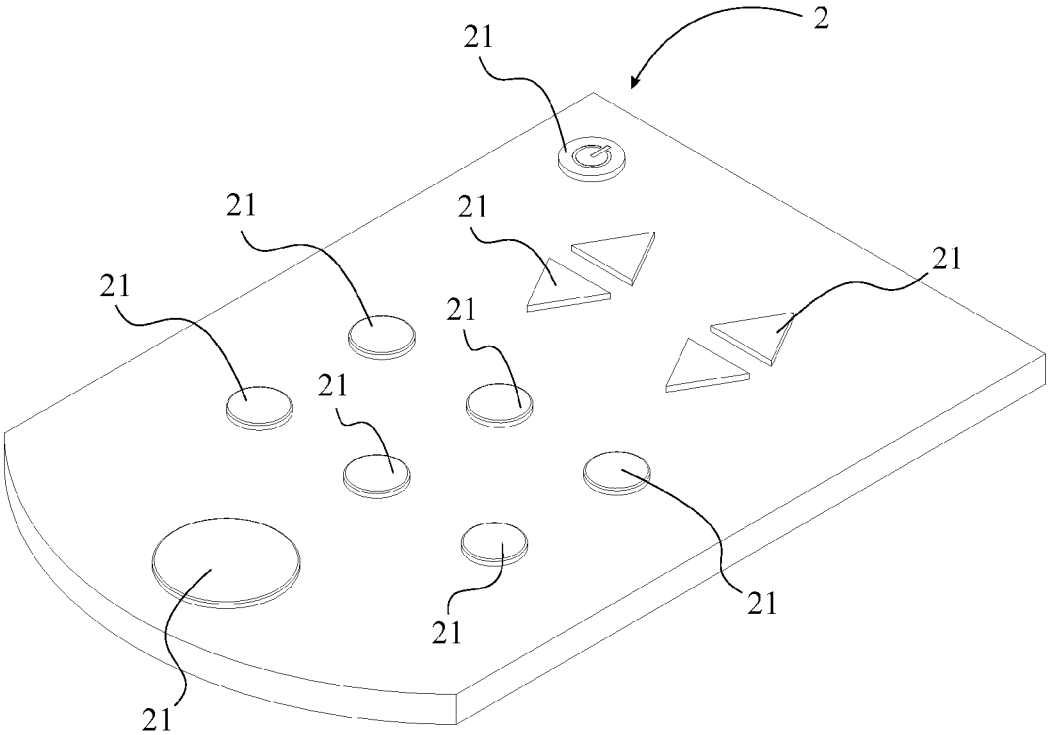
FIG. 4 is a perspective view of a remote control device of the present invention.

In reference to FIG. 4 and FIG. 12, the remote control device 2 allows the users to have complete control over desired lighting effects in the at least one tap handle 1 as the LED light strip 12 is remotely controlled by the remote control device 2 through the handle chipset 15. The users, such as bartenders, owners, managers, etc., are given complete control over the lighting of the at least one tap handle 1 through the remote control device 2. The remote control device 2 comprises a plurality of control buttons 21 which controls all of the functions related to the color spectrum of the LED light strip 12. Each button in the plurality of control buttons 21 is given a specific functionality to simplify the process. The plurality of control buttons 21 allows the users to adjust the illumination (dim or brighten), control fade effects between colors, flash the colors for added lighting effect, transition between set colors, and turn the handle on or off to preserve the battery 13 life. It is possible to create the present invention without the remote control device 2; this adaptation would limit the effectiveness of the color spectrum as the LED light strip 12 may operate by a control panel of the holder 113.

In reference to FIG. 12, the LED light strip 12 can also be controlled by a remote computing device 5, where the remote computing device 5 is controlled by an authorized user. When the remote computing device 5 is communicably coupled with the at least one charging unit 3 through software connections or virtual private network connection, the remote computing device is able to control the LED light strip 12 as the at least one charging unit 3 communicably coupled with the handle chipset 15 through the wireless network. The remote computing device is also able to edit the short text message with a website landing link as the authorized user desired. For example, the short text message with a website landing link can be a business promotional message with a hyperlink to the establishment website, a daily special message with a hyperlink to the establishment menu, a coupon message with a hyperlink to online coupons.

The plurality of web enabled computing devices 4 of the present invention is also able to remotely control the LED light strip 12 through the handle chipset 15. In order to accomplish remote operation of the LED light strip 12 by the plurality of web enabled computing devices 4, the plurality of web enabled computing devices 4 needs to download specific mobile application which correlates with the LED light strip 12 and functions same as the remote control device 2. Once the specific mobile application is downloaded to the plurality of web enabled computing devices 4, each of the plurality of web enabled computing devices 4 can control the LED light strip 12 for predetermine time period.

Once the LED light strip 12 provides light, the transparent face 112, which contains the decals, allows the light to shine through while creating the illuminated effect. The branded handle casing 11 can be manufactured to meet the purchasers' needs for design and look. When the present invention is obtained by the users, the users need to connect the at least one tap handle 1 to an already existing beer tower. First users need to unscrew the existing tap handles and then screw the at least one tap handle 1 into the beer towers. By doing this, there is virtually no transition for the bars and restaurants to start using the at least one tap handle 1. Then at least one charging unit 3 is connected with the internet providing source and the external power source, and the at least one charging unit 3 is positioned hidden from customers. If the users need to keep the at least one tap handle 1 charging within the beer tower during business hours, a separate induction charging unit can be connected to the beer towers. The separate induction charging unit uses the power established within the beer tower and powers the at least one tap handle 1 from a distance. Different battery life cycles batteries 13 may be used within the present invention, if the present invention uses the separate induction charging unit. For example, since the separate induction charging unit provides consistent power, the consistence power only required smaller battery 13 with 1-2 hour battery backup. The functionality of the LED light strip 12 are handled by the remote control device 2, the remote computing device 5, and the plurality of web enabled computing devices 4. By illuminating each of the at least one tap handle 1, the present invention allows for different brands to stand out within the bars and restaurants. For an example, consumers can simply walk into the bars or restaurants and order the any available products, as the available products are visible to the consumers through the at least one tap handle 1. If the bars and restaurants are temporally out of a certain product, they can switch off the LED light strip 12 of the specific handle casing 11. The present invention is also able to promote businesses while creating an inviting environment for the customers through the personal-area network and the wireless network. At the end of the shift, the at least one tap handle 1 is un-screwed from the beer tower and placed on the at least one charging unit 3 to recharge the battery 13.

Although the invention has been explained in relation to its preferred embodiment, it is to be understood that many other possible modifications and variations can be made without departing from the spirit and scope of the invention as hereinafter claimed.

What is claimed is:

1. A system for illuminated tap handles comprises:
at least one tap handle;
a remote control device;
at least one charging unit;
a plurality of web enabled computing devices;
each of the at least one tap handle comprises a handle casing, a light-emitting diode (LED) light strip, a battery, a bottom connector, and a handle chipset; and
the charging unit comprises an attachment cavity, a wireless personal-area network module, a wireless local area network module, a power supply unit, a charging unit chipset, and a wide area network (WAN) port.

2. The system for illuminated tap handles as claimed in claim 1 comprises:
the handle casing being positioned atop the bottom connector; and
the LED light strip, the battery, and the handle chipset being positioned within the handle casing.

3. The system for illuminated tap handles as claimed in claim 2 comprises:
the handle casing comprises a top connector, a transparent face, and a holder;
the transparent face being hermetically connected with the top connector and the holder at each extremity;
the top connector and the holder being oppositely positioned from each other along the transparent face;
the bottom connector being hermetically connected with the holder;
the battery and the handle chipset being connected with the holder;
the battery and the handle chipset being oppositely positioned from the bottom connector; and
the LED light strip being positioned in between the battery and the top connector.

4. The system for illuminated tap handles as claimed in claim 2 comprises:
the battery, the handle chipset, and the LED light strip being electrically connected with each other; and
the handle chipset being communicably coupled with the LED light strip.

5. The system for illuminated tap handles as claimed in claim 4 comprises:
the LED light strip comprises a plurality of light-emitting diode lights; and
the plurality of LED lights being electrically connected to each other along the LED light strip.

6. The system for illuminated tap handles as claimed in claim 1 comprises:
the attachment cavity being positioned on the at least one charging unit;
the bottom connector being inserted into the attachment cavity, wherein the at least one charging unit recharges the battery;
the wireless personal-area network module, the charging unit chipset, and the wireless local area network module being positioned within the at least one charging unit;
the power supply unit and the WAN port being positioned on the at least one charging unit;
the power supply unit being electrically connected with the wireless personal-area network module, the charging unit chipset, and the wireless local area network module;
the WAN port being communicably coupled with the wireless personal-area network module, the charging unit chipset, and the wireless local area network module; and
the charging unit chipset being communicably coupled with the wireless personal-area network module and the wireless local area network module.

7. The system for illuminated tap handles as claimed in claim 1 comprises:
the plurality of web enabled computing devices being communicably coupled with the at least one charging unit through the wireless personal-area network module.

8. The system for illuminated tap handles as claimed in claim 1 comprises:
the plurality of web enabled computing devices being communicably coupled with the at least one charging unit through the wireless local area network module.

9. The system for illuminated tap handles as claimed in claim 1 comprises:
the LED light strip being remotely controlled by the plurality of web enabled computing devices through the handle chipset.

10. The system for illuminated tap handles as claimed in claim 1 comprises:
the LED light strip being remotely controlled by the remote control device through the handle chipset, wherein the remote control device comprises a plurality of control buttons.

11. The system for illuminated tap handles as claimed in claim 1 comprises:
the LED light strip being remotely controlled by a remote computing device;
the remote computing device being communicably coupled with the at least one charging unit; and
the at least one charging unit being communicably coupled with the handle chipset.

12. A system for illuminated tap handles comprises:
at least one tap handle;
a remote control device;
at least one charging unit;
a plurality of web enabled computing devices;
each of the at least one tap handle comprises a handle casing, a light-emitting diode (LED) light strip, a battery, a bottom connector, and a handle chipset;
the charging unit comprises an attachment cavity, a wireless personal-area network module, a wireless local area network module, a power supply unit, a charging unit chipset, and a wide area network (WAN) port;
the handle casing being positioned atop the bottom connector; and
the LED light strip, the battery, and the handle chipset being positioned within the handle casing.

13. The system for illuminated tap handles as claimed in claim 12 comprises:
the handle casing comprises a top connector, a transparent face, and a holder;

the transparent face being hermetically connected with the top connector and the holder at each extremity;

the top connector and the holder being oppositely positioned from each other along the transparent face;

the bottom connector being hermetically connected with the holder;

the battery and the handle chipset being connected with the holder;

the battery and the handle chipset being oppositely positioned from the bottom connector; and the LED light strip being positioned in between the battery and the top connector.

14. The system for illuminated tap handles as claimed in claim 12 comprises:

the battery, the handle chipset, and the LED light strip being electrically connected with each other;

the handle chipset being communicably coupled with the LED light strip;

the LED light strip comprises a plurality of light-emitting diode lights; and the plurality of LED lights being electrically connected to each other along the LED light strip.

15. The system for illuminated tap handles as claimed in claim 12 comprises:

the attachment cavity being positioned on the at least one charging unit;

the bottom connector being inserted into the attachment cavity, wherein the at least one charging unit recharges the battery;

the wireless personal-area network module, the charging unit chipset, and the wireless local area network module being positioned within the at least one charging unit;

the power supply unit and the WAN port being positioned on the at least one charging unit;

the power supply unit being electrically connected with the wireless personal-area network module, the charging unit chipset, and the wireless local area network module;

the WAN port being communicably coupled with the wireless personal-area network module, the charging unit chipset, and the wireless local area network module; and the charging unit chipset being communicably coupled with the wireless personal-area network module and the wireless local area network module.

16. The system for illuminated tap handles as claimed in claim 12 comprises:

the plurality of web enabled computing devices being communicably coupled with the at least one charging unit through the wireless personal-area network module.

17. The system for illuminated tap handles as claimed in claim 12 comprises:

the plurality of web enabled computing devices being communicably coupled with the at least one charging unit through the wireless local area network module.

18. The system for illuminated tap handles as claimed in claim 12 comprises:

the LED light strip being remotely controlled by the plurality of web enabled computing devices through the handle chipset.

19. The system for illuminated tap handles as claimed in claim 12 comprises:

the LED light strip being remotely controlled by the remote control device through the handle chipset, wherein the remote control device comprises a plurality of control buttons.

20. The system for illuminated tap handles as claimed in claim 12 comprises:

the LED light strip being remotely controlled by a remote computing device;

the remote computing device being communicably coupled with the at least one charging unit; and the at least one charging unit being communicably coupled with the handle chipset.

* * * * *